US010634369B1

(12) United States Patent
Al-Deraiei

(10) Patent No.: US 10,634,369 B1
(45) Date of Patent: Apr. 28, 2020

(54) DUAL-CYCLE AND DUAL-OUTLET AIR CONDITIONER

(71) Applicant: Waleed KH. A. KH. Al-Deraiei, Safat (KW)

(72) Inventor: Waleed KH. A. KH. Al-Deraiei, Safat (KW)

( * ) Notice: Subject to any disclaimer, the term of this patent is extended or adjusted under 35 U.S.C. 154(b) by 0 days.

(21) Appl. No.: 16/387,403

(22) Filed: Apr. 17, 2019

(51) Int. Cl.

| | |
|---|---|
| ***F24F 3/00*** | (2006.01) |
| ***F24F 3/044*** | (2006.01) |
| ***F24F 13/30*** | (2006.01) |
| ***F24F 13/28*** | (2006.01) |
| *F24F 3/02* | (2006.01) |

(52) U.S. Cl.
CPC ..... *F24F 3/044* (2013.01); *F24F 13/28* (2013.01); *F24F 13/30* (2013.01); *F24F 3/02* (2013.01); *F25B 2400/06* (2013.01)

(58) Field of Classification Search
CPC ..... F24F 3/04; F24F 3/044; F24F 3/02; F25B 2400/06
See application file for complete search history.

(56) References Cited

U.S. PATENT DOCUMENTS 3,305,001 A 2/1967 Haufler et al.
3,406,528 A * 10/1968 Dijt ..... F24F 11/30 62/89
4,157,649 A * 6/1979 Bussjager ..... F25B 13/00 62/160
4,206,599 A * 6/1980 Sumiyoshi ..... F01N 3/22 123/531
4,259,847 A * 4/1981 Pearse, Jr. ..... F24F 1/02 236/1 E
4,445,342 A 5/1984 Warner
5,205,130 A * 4/1993 Pannell ..... B60H 1/00364 62/134
5,709,100 A * 1/1998 Baer ..... F25D 19/04 62/259.2
6,932,148 B1 * 8/2005 Brummett ..... B60H 1/00378 123/142.5 R
9,599,353 B2 3/2017 Cur et al.
2002/0017107 A1 * 2/2002 Bailey ..... F24F 3/001 62/238.7
2007/0074528 A1 * 4/2007 Rodriguez ..... F25D 11/003 62/371
2015/0108230 A1 4/2015 Cloonan et al.

FOREIGN PATENT DOCUMENTS

FR 2792397 A1 10/2000

* cited by examiner

*Primary Examiner* — Edward F Landrum
*Assistant Examiner* — Alexis K Cox
(74) *Attorney, Agent, or Firm* — Richard C. Litman; Nath, Goldberg & Meyer

(57) ABSTRACT

The dual-cycle and dual-outlet air conditioner includes two separate condensation-evaporation cycles that operate independently with respect to one another, but are contained within the same housing. Each cycle includes its own evaporator and condenser, but with a common return air intake/evaporator blower and a common condenser/exhaust fan. Two separate streams of cooled air are produced by the two separate evaporators, which may then be transferred through two separate ducts to supply cooled air to different zones within a building. The two separate condensation-evaporation cycles may be independently controlled by separate thermostats in the different zones of the building.

1 Claim, 1 Drawing Sheet

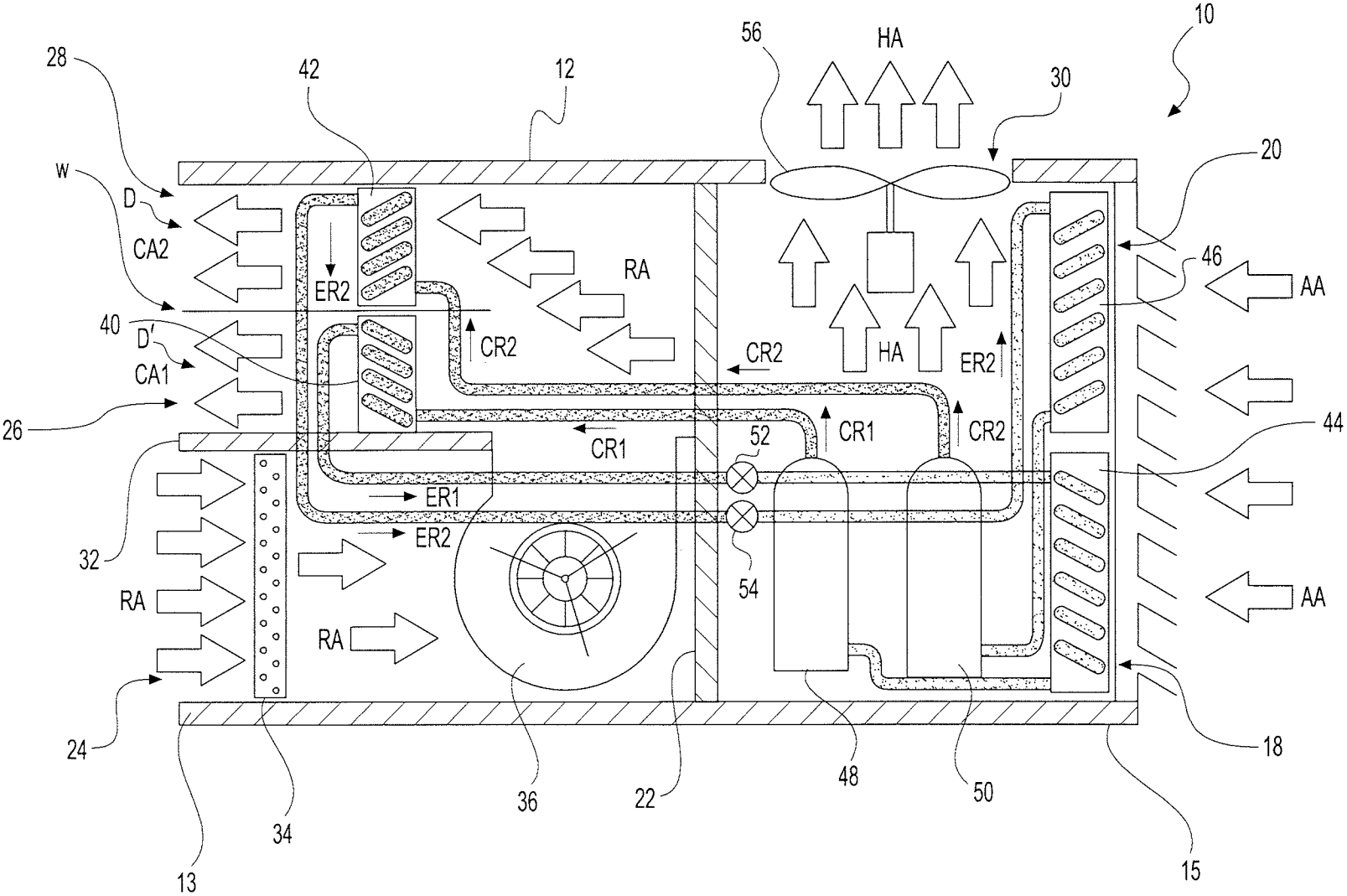
10
20
46
AA
44
AA
18
15
30
HA
56
ER2
CR2
HA
CR1
50
48
CR2
52
54
22
RA
CR1
12
36
CR2
ER1
ER2
42
ER2
RA
34
13
D
CA2
W
40
D'
CA1
26
32
RA
24
28

DUAL-CYCLE AND DUAL-OUTLET AIR CONDITIONER

BACKGROUND

1. Field

The disclosure of the present patent application relates to air conditioning systems, and particularly to a dual-cycle and dual-outlet air conditioner that has two separate condensation-evaporation cycles operating independently with respect to one another, but contained within a common housing.

2. Description of the Related Art

In a typical air conditioning system used in houses or other buildings, a single thermostat is often provided to control the air conditioning system. For control over a single room or other small region, a single thermostat is often sufficient. However, for larger buildings with multiple zones or rooms, having separate temperature control for each zone or room would be far more effective for maintaining desired interior temperatures. Although window-mounted air conditioning units may be provided in individual rooms, allowing for room-by-room control over temperature, it is not possible to provide such individualized control for a single central air conditioning system. Thus, in order to provide separate temperature control for separate regions, zones, or rooms using a conventional air conditioning system, multiple such systems must be installed, greatly increasing equipment costs, installation costs and maintenance costs. It would obviously be desirable to be able to provide separate temperature control for a single centralized air conditioning system. Thus, a dual-cycle and dual-outlet air conditioner solving the aforementioned problems is desired.

SUMMARY

The dual-cycle and dual-outlet air conditioner includes two separate condensation-evaporation cycles that operate independently with respect to one another, but are contained within the same housing. Each cycle includes its own evaporator and condenser but with a common return air intake/evaporator blower and a common condenser/exhaust fan. Two separate streams of cooled air are produced by the two separate evaporators, which may then be transferred through two separate ducts to supply cooled air to different zones within a building. The two separate condensation-evaporation cycles may be independently controlled by separate thermostats in the different zones of the building.

The dual-cycle and dual-outlet air conditioner includes a housing having laterally opposed first and second portions. An interior inlet, a first interior outlet and a second interior outlet are formed through the first portion, and an exterior outlet, a first exterior inlet and a second exterior inlet are formed through the second portion. An internal wall may be mounted within the housing for thermally separating the first portion of the housing from the second portion of the housing.

First and second evaporator coils are respectively mounted in the first portion of the housing adjacent the first and second interior outlets. A blower is mounted in the first portion of the housing for drawing return air through the interior inlet and over the first and second evaporator coils to blow first and second cooled air streams, respectively, out of the first and second interior outlets. The first portion is adapted for mounting within an interior of the building, allowing the return air to be partially cooled indoor air being drawn through the dual-cycle and dual-outlet air conditioner as part of the continuous cooling cycle. A return air filter may be mounted within the first portion of the housing adjacent the interior inlet for filtering the return air.

First and second condenser coils are mounted in the second portion of the housing adjacent the first and second exterior inlets. An exhaust fan is mounted in the second portion of the housing for drawing ambient air through the first and second exterior inlets and respectively over the first and second condenser coils to blow a heated air stream out of the exterior outlet. The second portion is adapted for mounting exterior to the building, such that the ambient air is heated external air, which is further heated through heat transfer with the first and second condenser coils. First and second condensers are respectively in cyclical fluid communication with the first and second evaporator coils and the first and second condenser coils.

In use, a first evaporated refrigerant is driven through the first condenser coil and the first condenser to condense the first evaporated refrigerant into a first condensed refrigerant. The ambient air being drawn across the first condenser coil cools the first evaporated refrigerant in the first condenser coil. The first condensed refrigerant is driven by the first compressor to pass through the first condenser and first evaporator coil to evaporate the first condensed refrigerant back into the first evaporated refrigerant. The first condensed refrigerant is evaporated by heat transfer with the return air passing across the first condensed refrigerant, generating the first stream of cooled air exiting the first interior outlet.

Similarly, a second evaporated refrigerant is driven through the second condenser coil and the second condenser to condense the second evaporated refrigerant into a second condensed refrigerant. The ambient air being drawn across the second condenser coil cools the second evaporated refrigerant in the second condenser coil. Heat transfer between the first and second evaporated refrigerants with the ambient air creates the heated air stream output through the exterior outlet. The second condensed refrigerant is driven by the second compressor to pass through the second condenser and the second evaporator coil to evaporate the second condensed refrigerant back into the second evaporated refrigerant. The second condensed refrigerant is evaporated by heat transfer with the return air passing across the second condensed refrigerant, generating the second stream of cooled air exiting the second interior outlet.

These and other features of the present invention will become readily apparent upon further review of the following specification.

BRIEF DESCRIPTION OF THE DRAWINGS

The sole drawing FIGURE is a schematic diagram of a dual-cycle and dual-outlet air conditioner.

DETAILED DESCRIPTION OF THE PREFERRED EMBODIMENTS

The dual-cycle and dual-outlet air conditioner 10 includes a housing 12 having laterally opposed first and second portions 13, 15, respectively. An interior inlet 24, a first interior outlet 26 and a second interior outlet 28 are formed in the first portion 13, and an exterior outlet 30, a first exterior inlet 18 and a second exterior inlet 20 are formed in the second portion 15. An internal wall 22 may be mounted within the housing 12 for thermally separating the first portion 13 of housing 12 from the second portion 15 of housing 12.

First and second evaporator coils 40, 42 are mounted in the first portion 13 of the housing 12 adjacent the first and second interior outlets 26, 28. A blower 36 is mounted in the first portion 13 of housing 12 for drawing return air RA through the interior inlet 24 and over the first and second evaporator coils 40, 42, respectively, to blow first and second cooled air streams CA1, CA2 respectively out of the first and second interior outlets 26, 28. It should be understood that any suitable type of blower fan may be utilized. The first portion 13 is adapted for mounting within an interior of the building, allowing the return air RA to be partially cooled indoor air being drawn through the dual-cycle and dual-outlet air conditioner 10 as part of the continuous cooling cycle. A return air filter 34 may be mounted within the first portion 13 of housing 12 adjacent the interior inlet 24 for filtering return air RA. Internal barrier 32 separates the interior inlet 24 from the first and second interior outlets 26, 28.

First and second condenser coils 44, 46 are mounted in the second portion 15 of housing 12 adjacent the first and second exterior inlets 18, 20, respectively. An exhaust fan 56 is mounted in the second portion 15 of housing 12 for drawing ambient air AA through the first and second exterior inlets 18, 20 and over the first and second condenser coils 44, 46, respectively, to blow a heated air stream HA out of the exterior outlet 30. The second portion 15 is adapted for mounting exterior to the building, such that the ambient air AA is heated external air, which is further heated through heat transfer with the first and second condenser coils 44, 46. First and second condensers 48, 50 are in cyclical fluid communication with the first and second evaporator coils 40, 42 and the first and second condenser coils 44, 46, respectively.

In use, a first evaporated refrigerant ER1 is driven through the first condenser coil 44 and the first condenser 48 to condense the first evaporated refrigerant ER1 into a first condensed refrigerant CR1. The ambient air AA being drawn across the first condenser coil 44 cools the first evaporated refrigerant ER1 in the first condenser coil 44. The first condensed refrigerant CR1 is driven by the first condenser 48 to pass through the first evaporator coil 40 to evaporate the first condensed refrigerant CR1 back into the first evaporated refrigerant ER1. The first condensed refrigerant CR1 is evaporated by heat transfer with the return air RA passing across the first condensed refrigerant CR1 in the first evaporator coil 40, generating the first stream of cooled air CA1 exiting the first interior outlet 26. As in a conventional evaporation-condensation cycle, a first expansion valve 52 may be provided between the first evaporator coil 40 and the first condenser coil 44.

Similarly, a second evaporated refrigerant ER2 is driven through the second condenser coil 46 and the second condenser 50 to condense the second evaporated refrigerant ER2 into a second condensed refrigerant CR2. The ambient air AA drawn across the second condenser coil 46 cools the second evaporated refrigerant ER2 in the second condenser coil 46. Heat transfer between the first and second evaporated refrigerants ER1, ER2 with the ambient air AA creates the heated air stream HA output through the exterior outlet 30. The second condensed refrigerant CR2 is driven by the second condenser 50 to pass through the second evaporator coil 42 to evaporate the second condensed refrigerant CR2 back into the second evaporated refrigerant ER2. The second condensed refrigerant CR2 is evaporated by heat transfer with the return air RA passing across the second condensed refrigerant CR2 in the second evaporator coil 42, generating the second stream of cooled air CA2 exiting the second interior outlet 28. As in a conventional evaporation-condensation cycle, a second expansion valve 54 may be provided between the second evaporator coil 42 and the second condenser coil 46.

The first and second streams of cooled air CA1, CA2 may then be transferred through two separate ducts D and D' to supply cooled air to different rooms, regions or zones within a building. The two separate condensation-evaporation cycles may be independently controlled by separate thermostats in the different rooms, regions or zones of the building. It should be understood that any suitable type of ductwork, depicted in the FIGURE by partition W, vents and the like may be used to transfer the first and second streams of cooled air CA1, CA2 to their desired destinations.

It is to be understood that the dual-cycle and dual-outlet air conditioner is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A dual-cycle and dual-outlet air conditioner, comprising:

an elongated housing, the elongated housing having a single internal wall mounted within the housing defining laterally opposed, distinct first and second portions, the first portion defining an interior inlet, a first interior outlet and a second interior outlet, the second portion defining an exterior outlet, a first exterior inlet and a second exterior inlet;

a return air filter mounted within the first portion of the housing adjacent the interior inlet for filtering return air;

an internal barrier mounted within the housing for thermally separating the interior inlet from the first and second interior outlets;

first and second evaporator coils mounted in the first portion of the housing and positioned adjacent the first and second interior outlets, respectively;

a blower mounted in the first portion of the housing and positioned for drawing return air through the interior inlet and over the first and second evaporator coils to blow first and second cooled air streams out of the first and second interior outlets, respectively;

first and second condenser coils mounted in the second portion of the housing and positioned adjacent the first and second exterior inlets, respectively;

an exhaust fan mounted in the second portion of the housing and positioned for drawing ambient air through the first and second exterior inlets and over the first and second condenser coils, respectively, to blow a heated air stream out of the exterior outlet;

first and second compressors mounted in the second portion of the housing, the first compressor being in a refrigeration loop solely with the first evaporator coil and the first condenser coil, the second compressor being in a refrigeration loop solely with the second evaporator coil and the second condenser coil;

a first refrigerant circulation system configured to circulate a first evaporated refrigerant through the first condenser coil and the first compressor to condense the first evaporated refrigerant into a first condensed refrigerant, and to circulate the first condensed refrigerant through the first evaporator coil to evaporate the first condensed refrigerant into the first evaporated refrigerant, and the first refrigerant circulation system is also configured to produce a first stream of cooled air at the first interior inlet;

a second refrigerant circulation system configured to circulate a second evaporated refrigerant through the second condenser coil and the second compressor to condense the second evaporated refrigerant into a second condensed refrigerant, and to circulate the second condensed refrigerant through the second evaporator coil to evaporate the second condensed refrigerant into the second evaporated refrigerant, the second refrigerant circulation system being independent of the first refrigerant circulation system, and the second refrigeration system is also configured to produce a second stream of cooled air at the second interior inlet; and an interior partition, the partition being configured to define first and second ducts disposed at the first and second interior outlets, respectively, wherein the first and second streams of cooled air are transferred to the first and second ducts, respectively.

* * * * *